US010871324B1

(12) United States Patent
Suzuka

(10) Patent No.: US 10,871,324 B1
(45) Date of Patent: Dec. 22, 2020

(54) PORTABLE SUIT AND HELMET DRYER

(71) Applicant: Yoshitaka Suzuka, Sakura (JP)

(72) Inventor: Yoshitaka Suzuka, Sakura (JP)

( * ) Notice: Subject to any disclaimer, the term of this patent is extended or adjusted under 35 U.S.C. 154(b) by 0 days.

(21) Appl. No.: 16/745,180

(22) Filed: Jan. 16, 2020

(51) Int. Cl.

| | |
|---|---|
| ***F26B 5/00*** | (2006.01) |
| ***F26B 3/06*** | (2006.01) |
| ***D06F 59/02*** | (2006.01) |
| ***F26B 9/00*** | (2006.01) |
| ***D06F 58/46*** | (2020.01) |
| *D06F 105/56* | (2020.01) |
| *D06F 105/30* | (2020.01) |

(52) U.S. Cl.
CPC ..... *F26B 3/06* (2013.01); *D06F 58/46* (2020.02); *D06F 59/02* (2013.01); *F26B 9/003* (2013.01); *D06F 2105/30* (2020.02); *D06F 2105/56* (2020.02)

(58) Field of Classification Search
CPC .. F26B 3/06; F26B 9/003; D06F 58/46; D06F 59/02; D06F 2105/56; D06F 2105/30; D06F 2105/32
USPC ..... 34/491, 487, 443, 413, 493, 509, 549
See application file for complete search history.

(56) References Cited

U.S. PATENT DOCUMENTS

| | | | | |
|---|---|---|---|---|
| 8,225,525 | B1 * | 7/2012 | Gallagher | A45C 9/00 206/288 |
| 2007/0193059 | A1 * | 8/2007 | Carey | A47L 23/205 34/229 |
| 2012/0186096 | A1 * | 7/2012 | Fox | A47L 23/205 34/104 |
| 2015/0189967 | A1 * | 7/2015 | McNeeley | A45D 20/12 34/98 |
| 2017/0002510 | A1 * | 1/2017 | Blake | D06F 59/02 |
| 2017/0241711 | A1 * | 8/2017 | Seehausen, Jr. | F26B 21/006 |
| 2020/0095723 | A1 * | 3/2020 | Hinkey | D06F 59/02 |

* cited by examiner

*Primary Examiner* — John P McCormack
(74) *Attorney, Agent, or Firm* — FisherBroyles, LLP; Rob L. Phillips

(57) ABSTRACT

A portable dryer for suits and helmets includes a housing; a motor driving one or more blowers; a first air duct for directing air from the one or more blowers into a helmet, the housing configured to receive the helmet over an outlet of the first air duct; and a pair of second rotatable air ducts each for directing air from the one or more blowers into a separate leg of a suit, the second pair of rotatable air ducts spaced from the first air duct so as not to interfere with the outlet of the first air duct. The rotatable air ducts may be replaced with flexible tubing. An optional suitcase may contain the suit and helmet dryer and include a telescoping pole on which to hang a suit to be dried.

7 Claims, 14 Drawing Sheets

PORTABLE SUIT AND HELMET DRYER

FIELD OF THE INVENTION

The embodiments of the present invention relate to a portable dryer for drying a suit (e.g., racing suit) and helmet (e.g., racing helmet) simultaneously.

BACKGROUND

Racing suits are traditionally made of flame-retardant material, such as NOMEX manufactured by DuPont, which retains moisture and heat. Thus, during a race, the racing suit tends to collect moisture and become damp or wet. Drivers do not enjoy wearing wet racing suits as they are uncomfortable and interfere with the driver's natural body temperature.

Accordingly, it would be advantageous to develop a portable dryer for quickly and easily drying the racing suit and helmet simultaneously.

SUMMARY

In one embodiment, the dryer comprises a housing; a motor driving one or more blowers; a first air duct for directing air from said one or more blowers into a helmet, said housing configured to receive said helmet over an outlet of said first air duct; and a pair of second rotatable air ducts each for directing air from said one or more blowers into a separate leg of a suit, said second pair of rotatable air ducts spaced from said first air duct so as not to interfere with said outlet of said first air duct.

In one embodiment, the pair of second rotatable air ducts are rigid and positioned on opposite sides of the housing and rotate 90° into an upright position to accommodate the pants legs of a suit. In another embodiment, the second pair of air ducts comprise flexible tubing or similar material.

In one embodiment, the suit and helmet dryer fits into a compact suitcase. The suitcase may include a telescoping polo on which the suit to be dried may hang while being dried.

Other variations, embodiments and features of the present invention will become evident from the following detailed description, drawings and claims.

DETAILED DESCRIPTION

Figure 1:
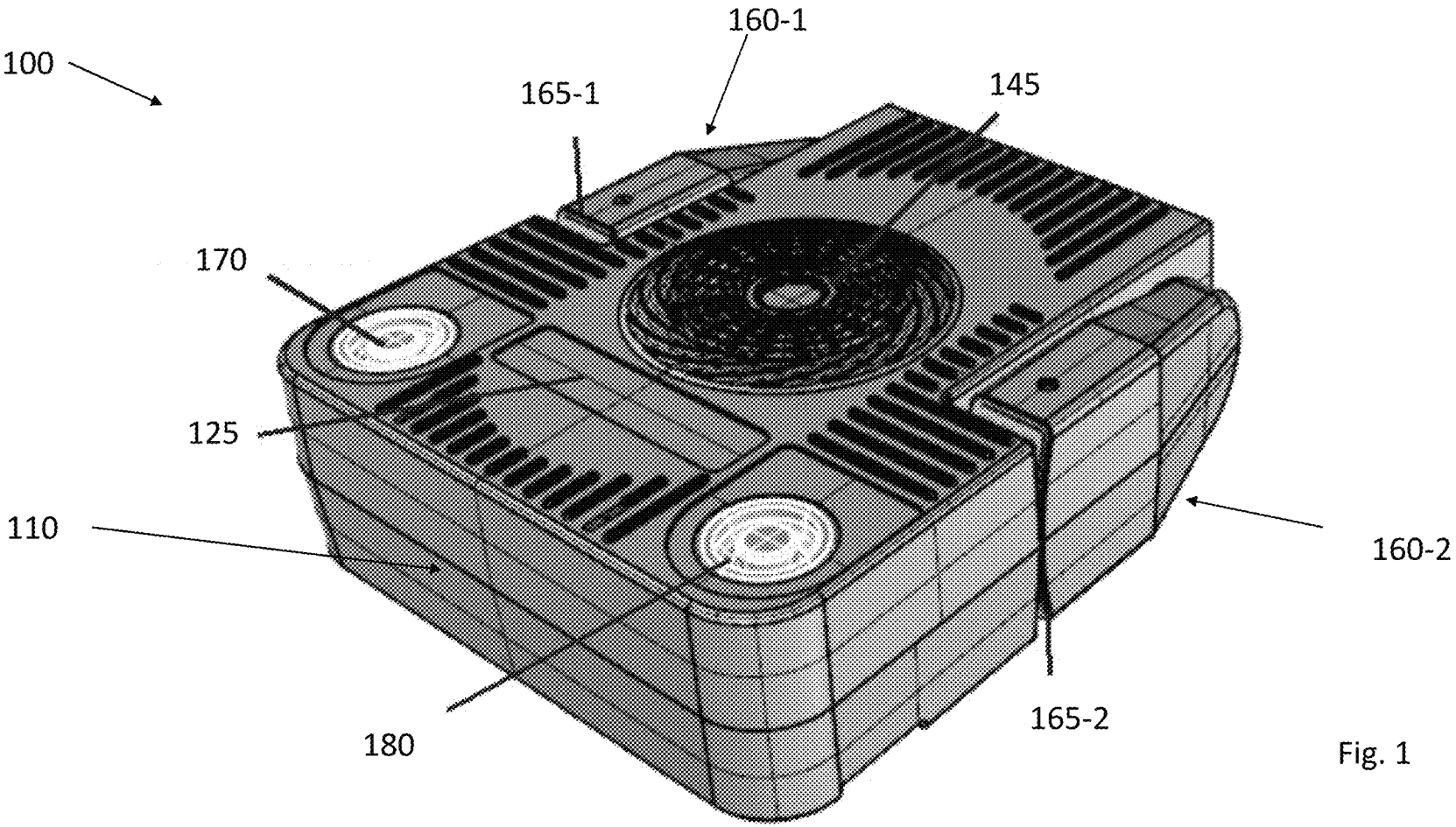
FIG. 1 illustrates an upper perspective view of a first embodiment of a suit and helmet dryer in stowed according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The dryer described herein may be fabricated of any number of materials including, but not limited to, plastics, composites, alloys, metals, polymers, ceramics, glasses, woods and/or combinations thereof. The dryer may be fabricated using one or more techniques including, but not limited to, machining, additive printing, forming, injection molding, casting, thermoforming and/or combinations thereof. Those skilled in the art will recognize that other materials and fabrication techniques may be used. The dryer may be fabricated as a single piece or multiple pieces attached to one another.

Figure 2:
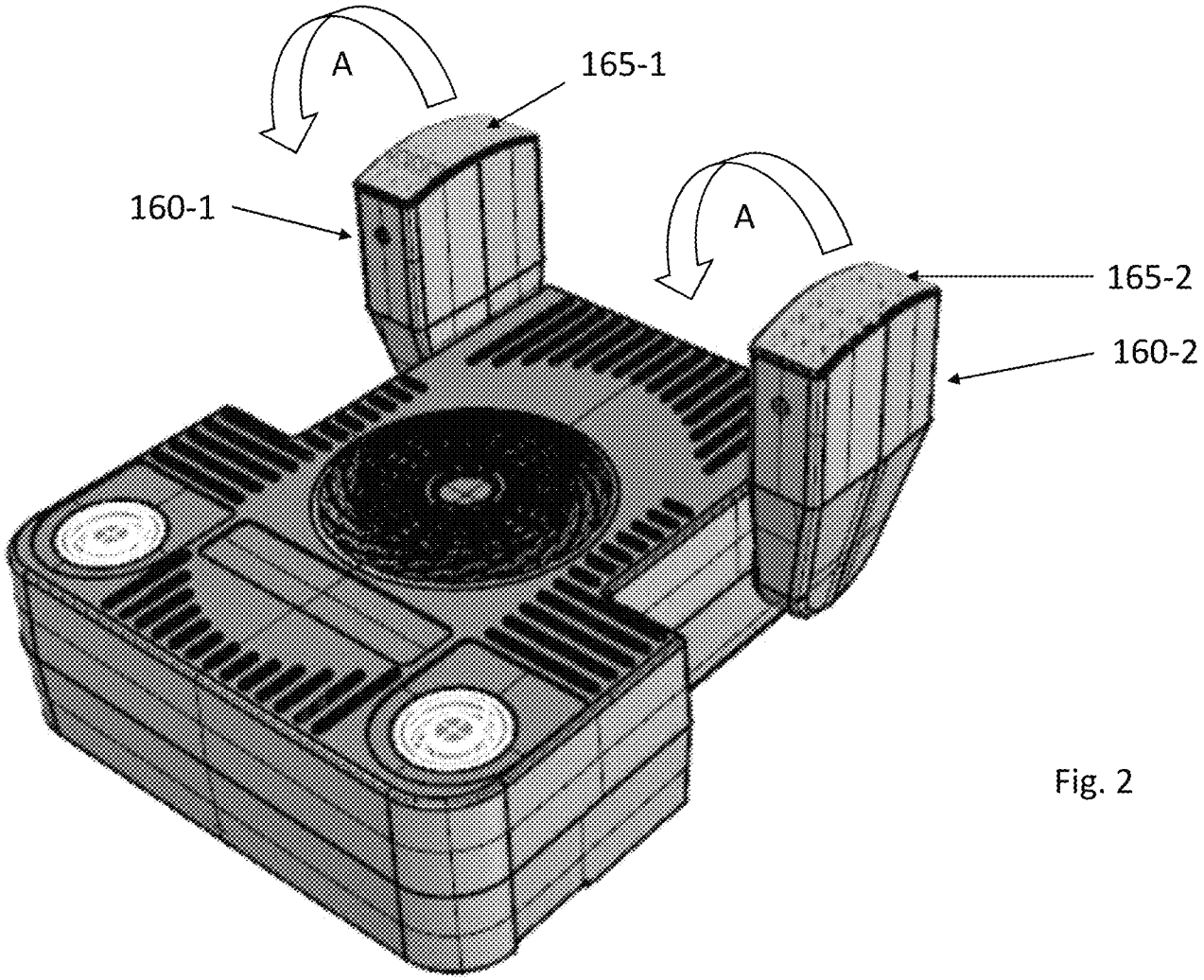
FIG. 2 illustrates an upper perspective view of the first embodiment of the suit and helmet dryer with a pair of second rotatable air ducts in an upright position according to the embodiments of the present invention.
Figure 3:
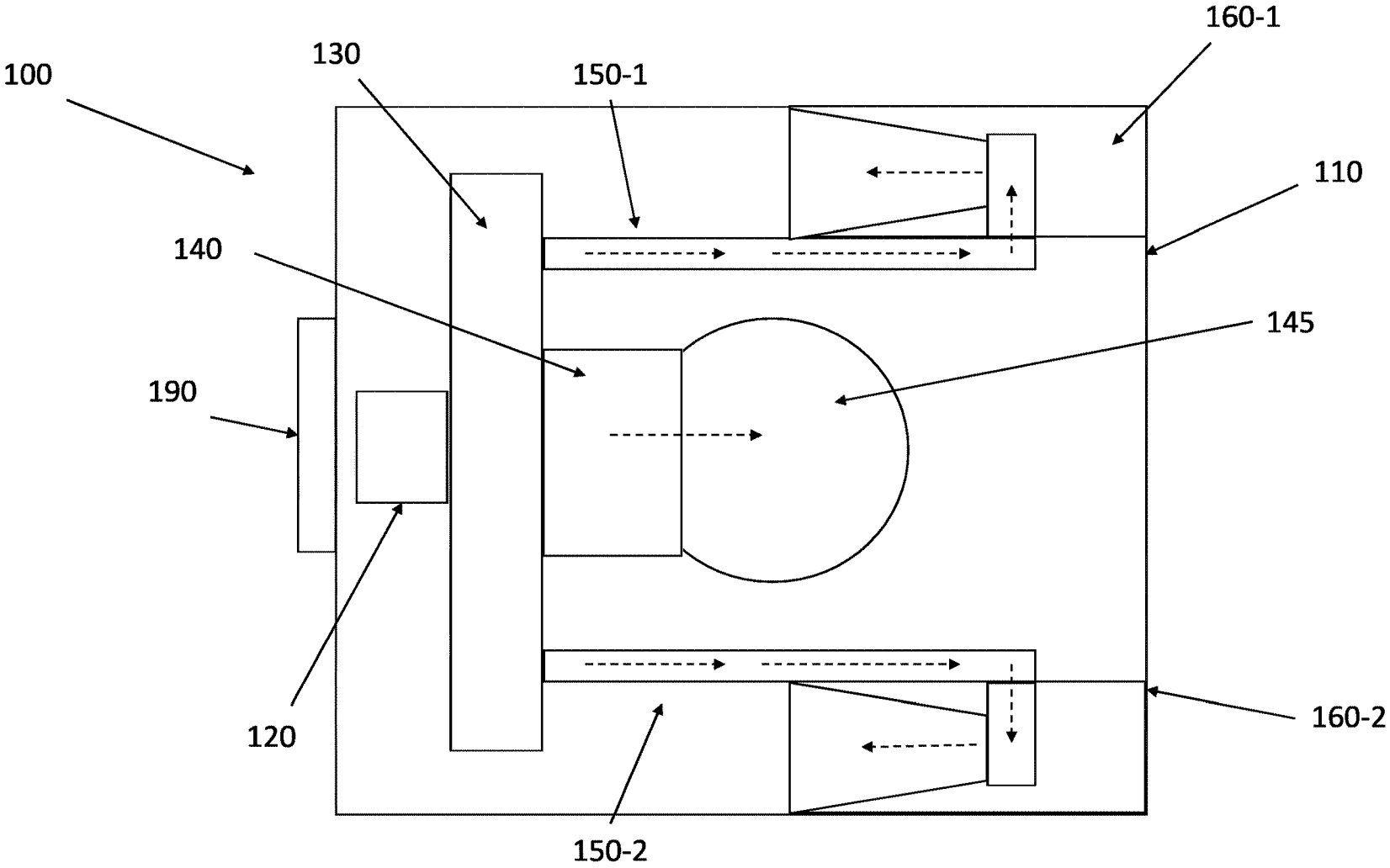
FIG. 3 illustrates a top down schematic of the internal components of the first embodiment of the suit and helmet dryer according to the embodiments of the present invention.

FIGS. 1 through 3 show a suit and helmet dryer 100 according to one embodiment of the present invention. In broad terms, the suit and helmet dryer 100 comprises a housing 110, motor 120, blower 130, first air duct 140, a pair of second air ducts 150-1, 150-2 leading to rotatable air ducts 160-1, 160-2. FIG. 3 shows the first air duct 140, pair of second air ducts 150-1, 150-2 leading from blower 130 to a first air duct outlet 145, rotatable air ducts 160-1, 160-2 and rotatable air duct outlets 165-1, 165-2. A logo placement area 125 permits the suit and helmet dryer 100 to be branded as desired.

FIGS. 1 and 3 show the rotatable air ducts 160-1, 160-2 in a stowed position while FIG. 2 shows the rotatable air ducts 160-1, 160-2 in a 90° rotated position for use. Rotating the air ducts 160-1, 160-2 as shown by arrows A move the air ducts 160-1, 160-2 back into the stowed position. In one embodiment, the rotatable air ducts 160-1, 160-2 are joined to the housing 100 via one or more fasteners (e.g., screws, hinges, nuts and bolts, rivets, etc.) which permit rotation thereof. Dotted arrows in FIG. 3 show the direction of air from the blower 130 through the first air duct 140, pair of second air ducts 150-1, 150-2 to the first air duct outlet 145, rotatable air ducts 160-1, 160-2 and rotatable air duct outlets 165-1, 165-2. As shown in FIG. 3, the rotatable air ducts 160-1, 160-2 are in the stowed position such that air exiting through the rotatable air duct outlets 165-1, 165-2 would not be directed into legs of a suit. That is, the rotatable air ducts 160-1, 160-2 first need to be rotated 90° into an upward position.

In one embodiment, the suit and helmet dryer 100 includes timers 170, 180 for controlling how long air blows into the helmet and suit via air duct outlets 145 and 165-1, 165-2, respectively. In one embodiment, a user interface 190 permits the user to vary the rate and temperature of air flow to each of the helmet and suit. In one embodiment, the interface 190 is a digital LCD or LED display. Alternatively, the interface 190 may comprise knobs, buttons, switches and the like.

Figure 4:
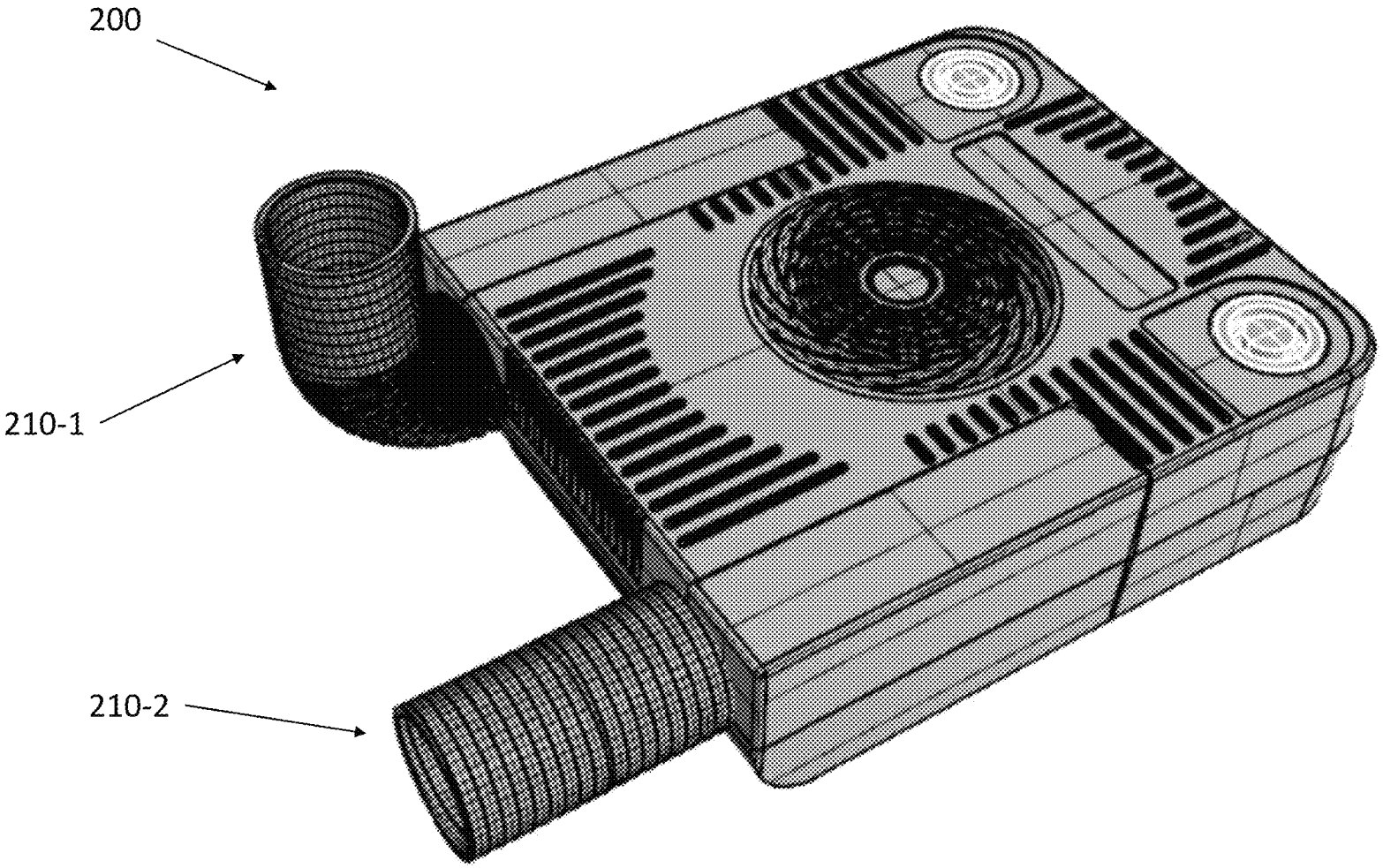
FIG. 4 illustrates an upper perspective view of a second embodiment of a suit and helmet dryer according to the embodiments of the present invention.
Figure 5:
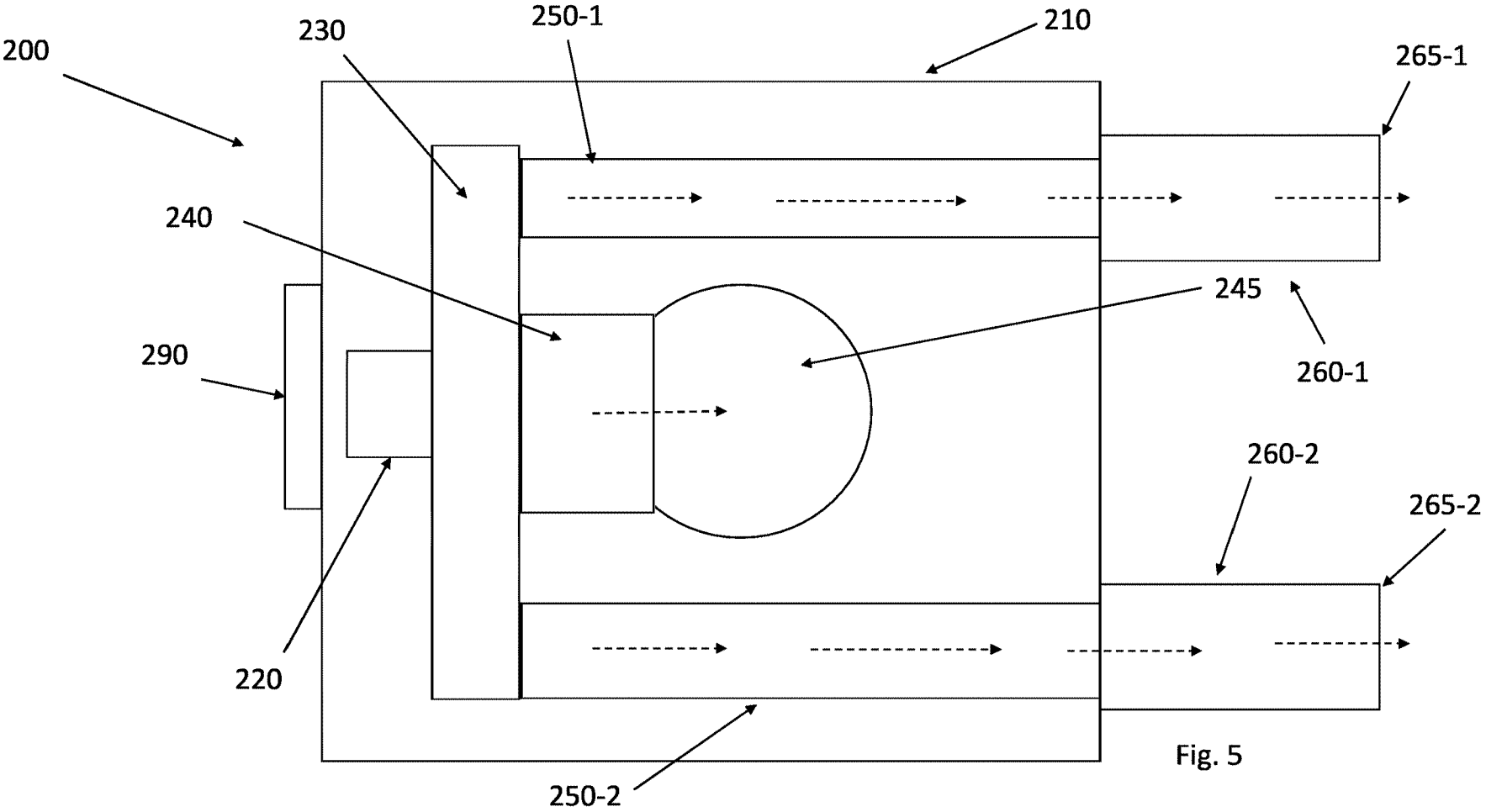
FIG. 5 illustrates a top down schematic of the internal components of the second embodiment of the suit and helmet dryer according to the embodiments of the present invention.
Figure 6:
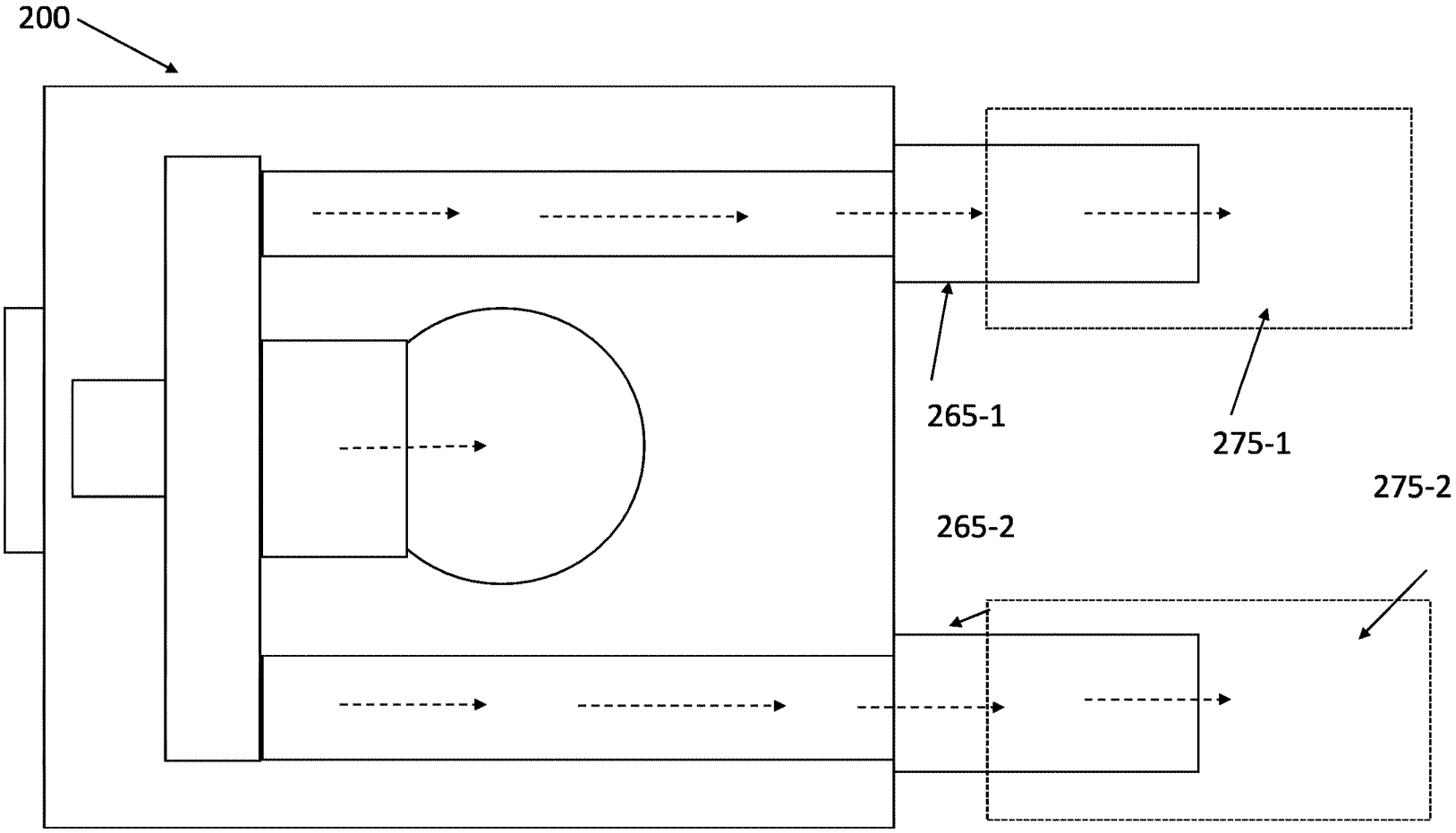
FIG. 6 illustrates the top down schematic of the internal components of the second embodiment of the suit and helmet dryer with a suit in place according to the embodiments of the present invention.

FIGS. 4 and 5 show an alternative embodiment of a suit and helmet dryer 200 according to the embodiments of the present invention. In this embodiment, the rotatable air ducts 160-1, 160-2 are replaced with flexible tubing 260-1, 260-2. In broad terms, the suit and helmet dryer 200 comprises a housing 210, motor 220, blower 230, first air duct 240, a pair of second air ducts 250-1, 250-2 leading to flexible tubing 260-1, 260-2. FIG. 5 shows the first air duct 240 and pair of second air ducts 250-1, 250-2 leading from blower 230 to a first air duct outlet 245 and flexible tubing outlets 265-1, 265-2. The flexible tubing 260-1, 260-2 permits a suit to be dried while hanging (i.e., tubing bent upward 90°) or while lying on the ground (i.e., tubing extending parallel to ground) as shown in FIG. 6. Suit and helmet dryer 200 also includes user interface 290.

Dotted arrows in FIGS. 5 and 6 show the direction of air from the blower 230 through the first air duct 240, pair of second air ducts 250-1, 250-2 to the first air duct outlet 245, flexible tubing 260-1, 260-2 and flexible tubing outlets 265-1, 265-2.

In FIG. 6, a suit is laid flat on the ground or atop of a short object such that the legs 275-1, 275-2 of the suit may be placed over the flexible tubing 260-1, 260-1 permitting the air to blow into and through the suit in same manner as when the suit is hanging and the rotatable air ducts 160-1, 160-2 are inserted into the legs of the suit.

Figure 7A:
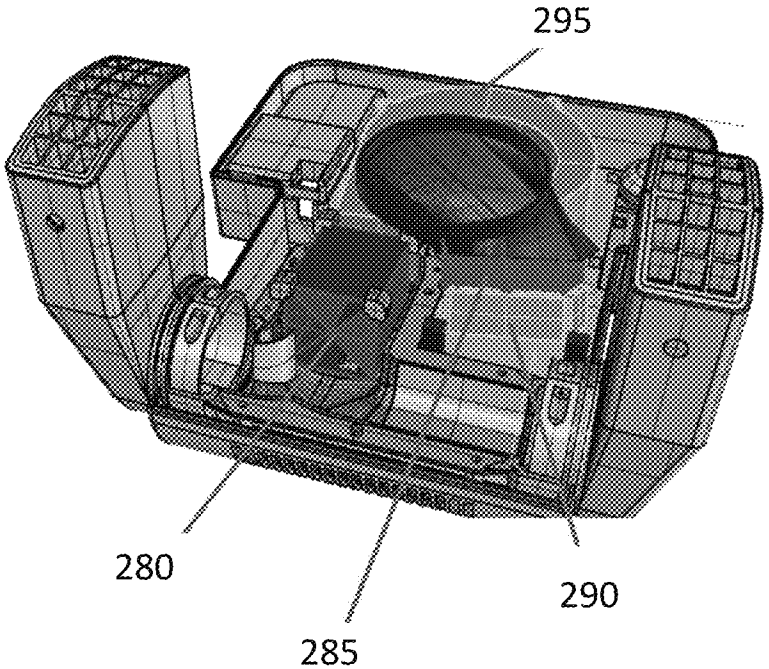
FIGS. 7A-7C illustrate views of the interior of the suit and helmet dryer according to the embodiments of the present invention.
Figure 7B:
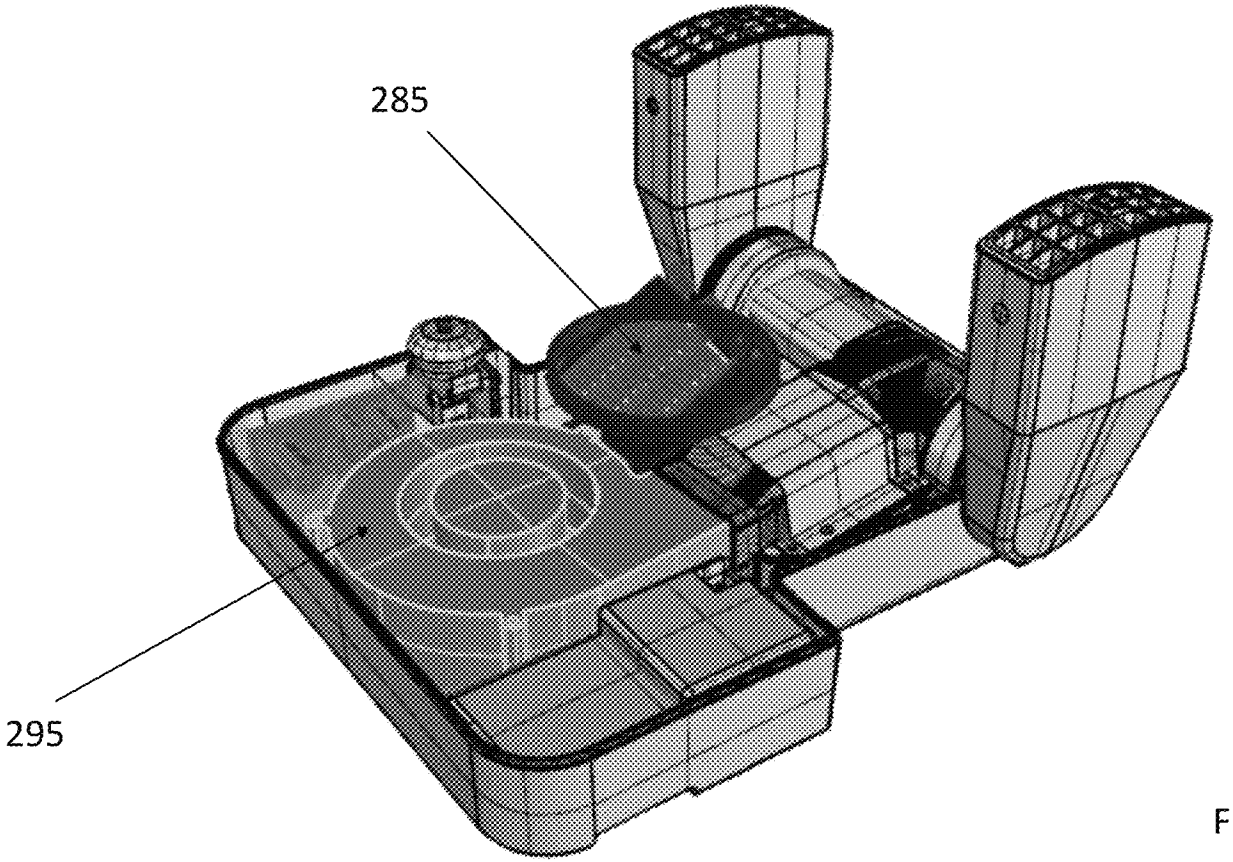
Figure 7C:
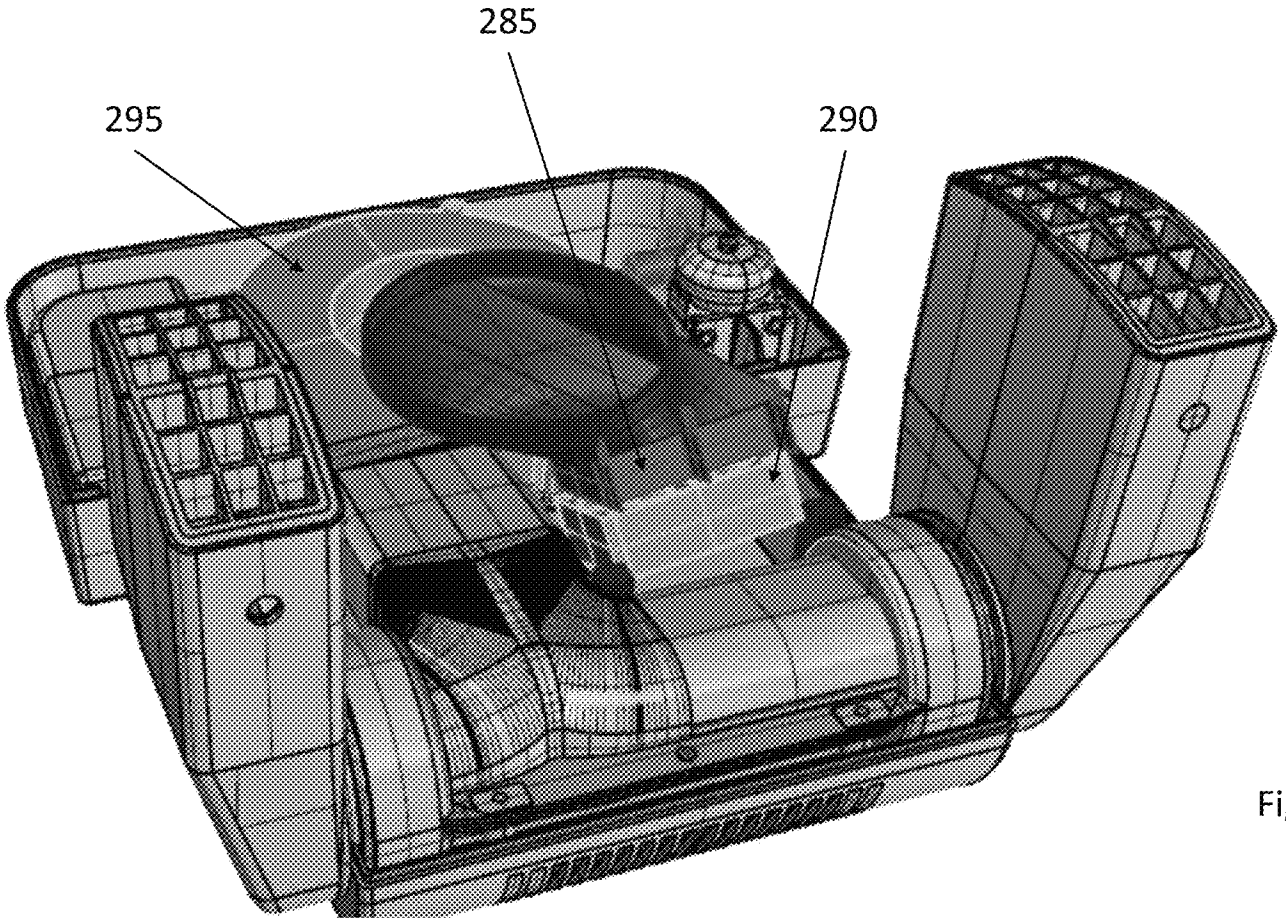
Figure 8:
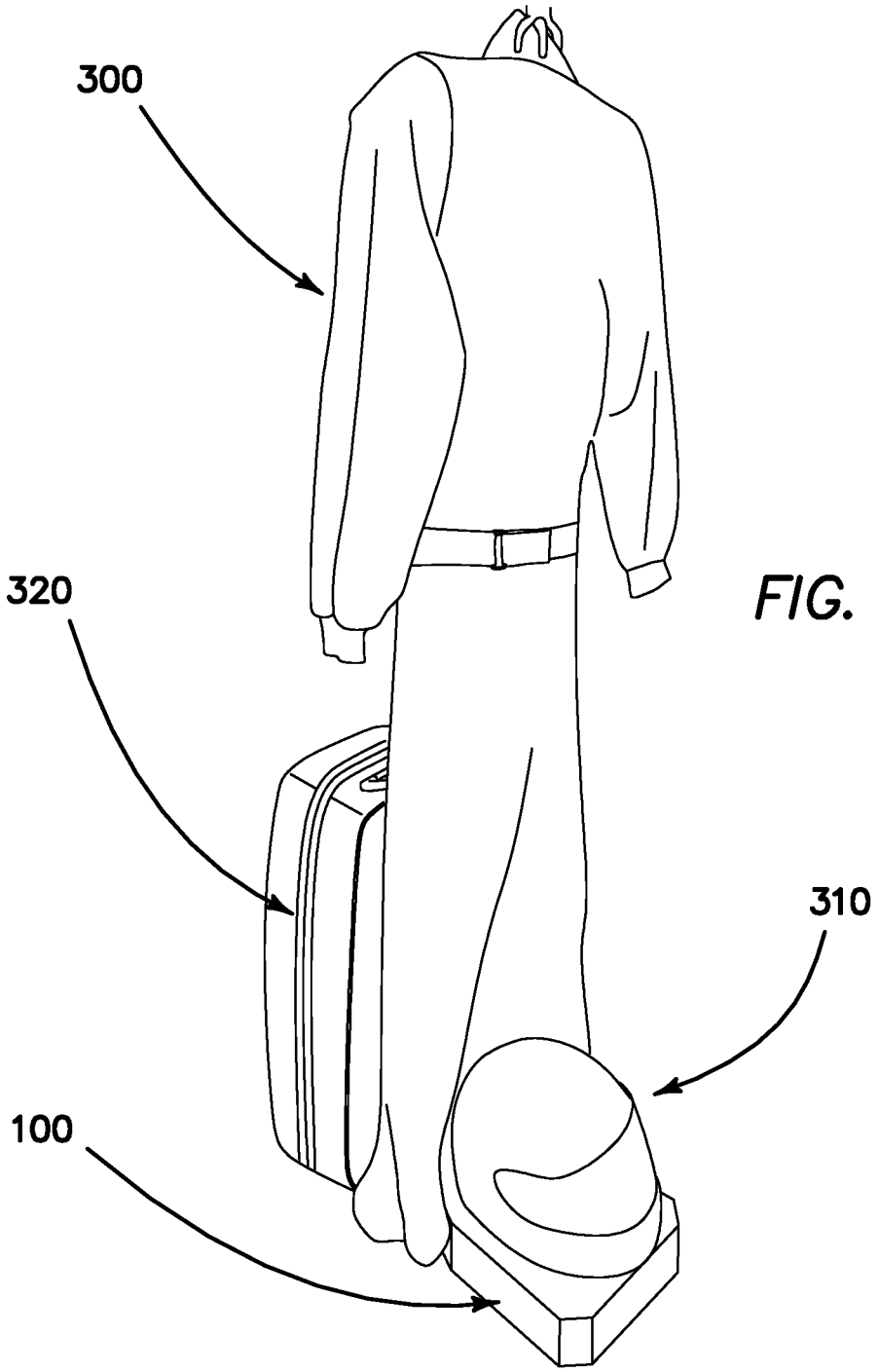
FIG. 8 illustrates a front view of a suit and helmet in a drying position relative to the first embodiment of the suit and helmet dryer.
Figure 9:
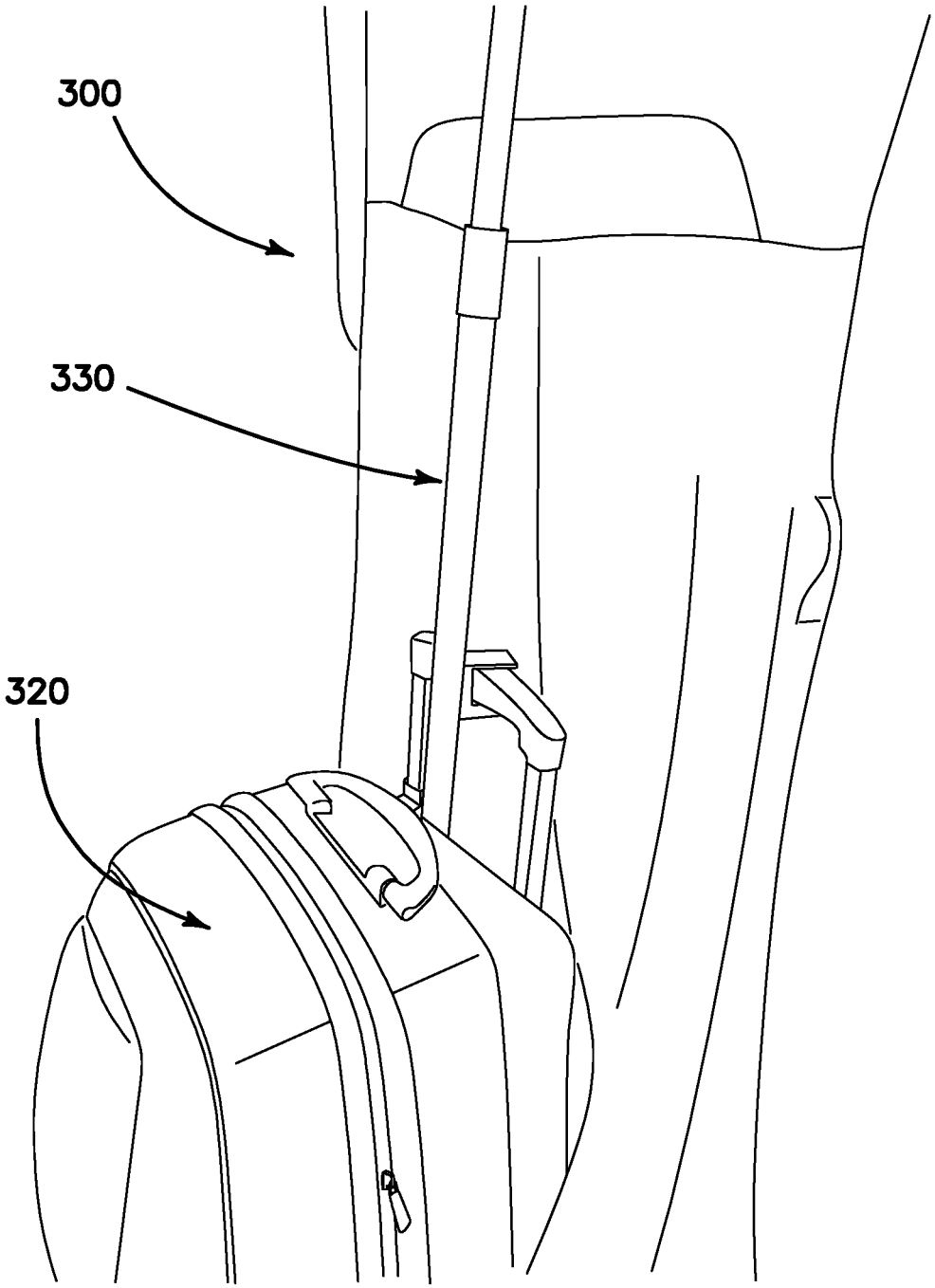
FIG. 9 illustrates a rear view of the suit and helmet in a drying position relative to the first embodiment of the suit and helmet dryer.
Figure 10:
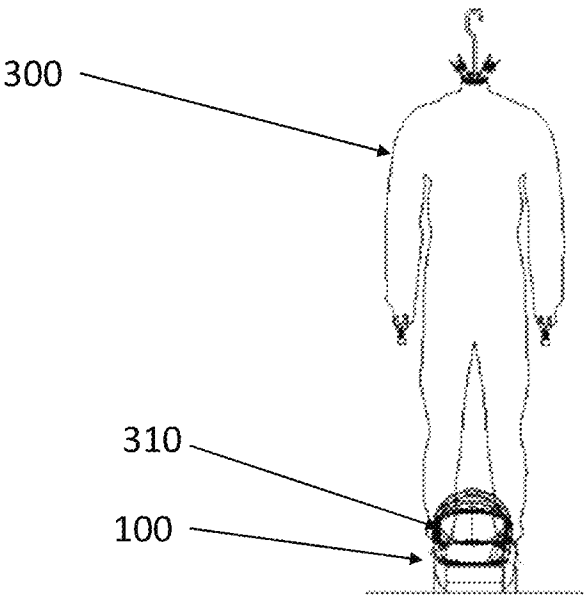
FIG. 10 illustrates a front view of a suit and helmet in a drying position supported by a telescoping pole according to the embodiments of the present invention.
Figure 11:
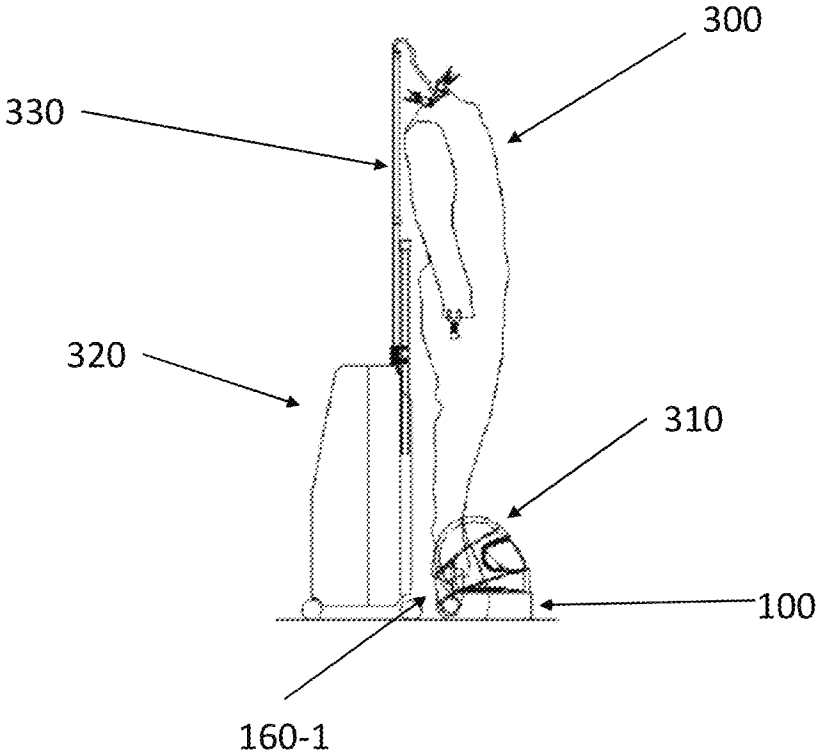
FIG. 11 illustrates a side view of the suit and helmet in a drying position supported by a telescoping pole according to the embodiments of the present invention.

FIGS. 7A-7C shows views of the interior of the suit and helmet dryer according to the embodiments of the present invention. FIGS. 7A-7C show a suit heater element 280, helmet heater element 285, helmet fan 290 and suit blower 295. In one embodiment, the suit heater element is a high wattage nichrome wire heater while the helmet heater element is a positive temperature coefficient (PTC) heating element. PTC elements have fast heating times and plateau at a pre-defined reference temperature. Beneficially, PTC is compact and allows the suit and helmet dryer 200 to maintain a relatively small size.

FIGS. 8-11 show a suit 300 and helmet 310 in drying position relative to suit and helmet dryer 100. The hot air to dry the suit 300 is directed upward through rotatable air ducts 160-1, 160-2 into the legs of the suit. Directing hot air into the suit from below is more efficient and effective than attempts to force air downward into the suit. In this embodiment, the suit and helmet dryer 100 is compact enough to fit into a suitcase 320. In one embodiment, the suitcase 320 incorporates an integral telescoping pole 330 on which to hang the suit 300 during the drying process.

Figure 12:
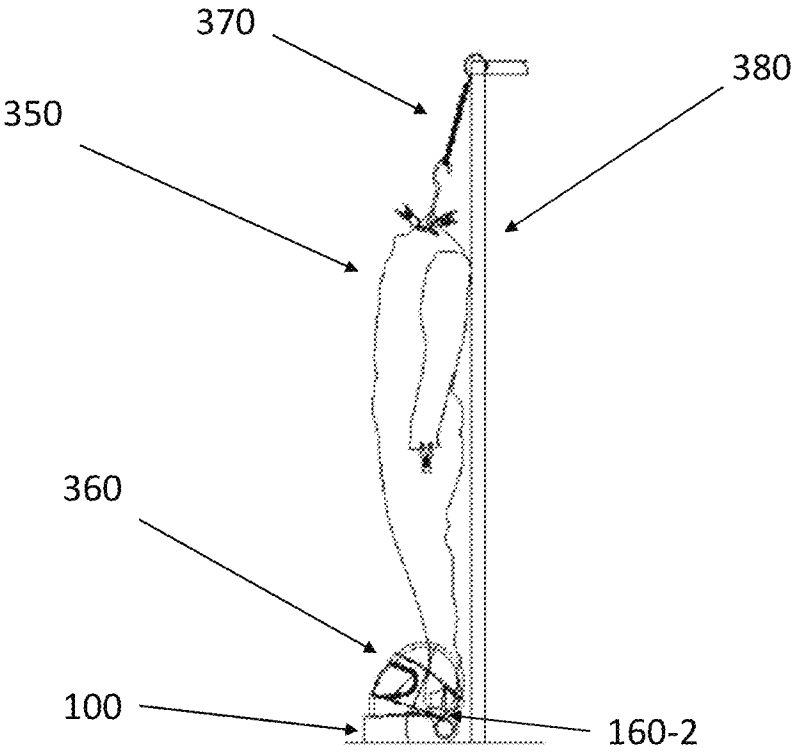
FIG. 12 illustrates a side view of the suit and helmet in a drying position supported by a rigid member according to the embodiments of the present invention.

FIG. 12 shows a suit 350 and helmet 360 being dried by suit and helmet dryer 100. In this instance, the suit 350 is hung via a strap and hook 370 attached to a rigid member 380 (e.g., wall in a shower room).

Depending on the embodiment, the suit and helmet dryer 100, 200 may be powered by conventional electrical, solar and/or battery sources. A remote control may be utilized to control the suit and helmet dryer in a conventional fashion.

While racing suits and helmets are ideal for the suit and helmet dryer disclosed herein, those skilled in the art will recognize that other suits and helmets may benefit as well. By way of example, a firefighter's turnouts and helmet or a football player's uniform and helmet may be dried using the embodiments of the present invention.

Although the invention has been described in detail with reference to several embodiments, additional variations and modifications exist within the scope and spirit of the invention as described and defined in the following claims.

I claim:

1. A dryer comprising:

a housing;

a motor driving one or more blowers;

a first air duct within said housing for directing air from said one or more blowers into a helmet, said housing configured to receive said helmet over an outlet of said first air duct; and a pair of rotatable air ducts each for directing air from said one or more blowers into a separate leg of a suit, said pair of rotatable air ducts spaced from said first air duct outlet so as not to interfere with said first air duct outlet; and a pair of air ducts within said housing leading from said one or more blowers to said pair of rotatable air ducts.

2. The dryer of claim 1 further comprising a timer for controlling how long said one or more blowers operate.

3. The dryer of claim 1 further comprising an interface for controlling a rate of air flow and air temperature created by said one or more blowers.

4. A dryer system comprising:

a housing;

a motor driving one or more blowers;

a first air duct for directing air from said one or more blowers into a helmet, said housing configured to receive said helmet over an outlet of said first air duct; and a second pair of air ducts within said housing for directing air from said one or more blowers into a pair of rotatable air ducts or pair of flexible tubing air ducts, said pair of rotatable air ducts or said pair of flexible tubing air ducts each for directing air into legs of a suit, said pair of rotatable air ducts or said pair of flexible tubing air ducts spaced from said first air duct so as not to interfere with said outlet of said first air duct; and a suitcase for containing said housing, said suitcase including an integral telescoping pole from which to hang said suit to be dried.

5. The dryer of claim 4 further comprising a timer for controlling how long said one or more blowers operate.

6. The dryer of claim 4 further comprising an interface for controlling a rate of air flow and air temperature created by said one or more blowers.

7. The dryer of claim 4 further comprising a strap and hook for hanging said suit from a rigid member.

* * * * *